US005257661A

United States Patent [19]

Frech et al.

[11] Patent Number: 5,257,661

[45] Date of Patent: Nov. 2, 1993

[54] HEAT EXCHANGER, ESPECIALLY A HEATING HEAT EXCHANGER IN ENGINE COOLING CIRCUIT OF A MOTOR VEHICLE

[75] Inventors: Stefan Frech, Jettingen; Günther Sigmund, Sindelfingen, both of Fed. Rep. of Germany

[73] Assignee: Daimler-Benz AG, Fed. Rep. of Germany

[21] Appl. No.: 557,708

[22] Filed: Jul. 25, 1990

[30] Foreign Application Priority Data

Jul. 25, 1989 [DE] Fed. Rep. of Germany ..... 3924550

[51] Int. Cl.[5] ..... F01P 11/02

[52] U.S. Cl. ..... 165/104.32; 123/41.54; 165/917

[58] Field of Search ..... 165/104.32, 110, 41, 165/51, 917; 123/41.51, 41.54

[56] References Cited

U.S. PATENT DOCUMENTS

| | | | |
|---|---|---|---|
| 2,343,145 | 2/1944 | Heiney | 165/104.32 |
| 2,841,127 | 7/1958 | Baster | 123/41.54 |
| 3,028,716 | 4/1962 | Sanderson et al. | 123/41.54 |
| 3,139,073 | 6/1964 | White et al. | 123/41.54 |
| 3,499,481 | 3/1970 | Avrea | 123/41.54 |
| 3,820,593 | 6/1974 | Pabst | 165/104.32 |
| 4,483,390 | 11/1984 | Araya et al. | 165/104.32 |
| 4,781,247 | 11/1988 | Schulz | 165/104.32 |

FOREIGN PATENT DOCUMENTS

| | | |
|---|---|---|
| 598044 | 5/1960 | Canada . |
| 1286713 | of 0000 | France . |
| 58-27680 | 2/1983 | Japan . |
| 61-175785 | 11/1986 | Japan . |
| WO8603554 | of 0000 | PCT Int'l Appl. . |
| 918221 | of 0000 | United Kingdom . |
| 1104978 | of 0000 | United Kingdom . |
| 1304319 | of 0000 | United Kingdom . |
| 2049149 | of 0000 | United Kingdom . |

*Primary Examiner*—Albert W. Davis, Jr.
*Attorney, Agent, or Firm*—Evenson, McKeown, Edwards & Lenahan

[57] ABSTRACT

A heat exchanger, especially a heating heat exchanger in the engine cooling circuit of a motor vehicle is disclosed. A forward-flow pipe opens at the top into a water box. A vent line of small cross-section is assigned to the forward-flow pipe and is guided to a compensating tank and there terminates below the liquid level. In order to obtain a simply constructed and at the same time highly effective venting facility, the vent line is brought into the operative position together with the fastening of the forward-flow pipe and is guided away from the highest point of the forward-flow water box to the compensating tank located at a distance therefrom.

7 Claims, 1 Drawing Sheet

HEAT EXCHANGER, ESPECIALLY A HEATING HEAT EXCHANGER IN ENGINE COOLING CIRCUIT OF A MOTOR VEHICLE

BACKGROUND AND SUMMARY OF THE INVENTION

The invention relates to a heating heat exchanger in the engine cooling circuit of a motor vehicle, with a forward-flow pipe opening at the top into a water box and with a vent line of small cross-section which is assigned to the forward-flow pipe and which is guided to a compensating tank and there terminates below the liquid level.

An arrangement of this type, with a horizontally disposed heat exchanger through which the flow therefore passes horizontally and which is intended for the separation and elimination of gaseous constituents carried along in the engine cooling circuit, is known form British Patent Specification 918,221. From the compensating tank adjacent to the forward-flow water box, the vent line leads into the mouth region of the forward-flow pipe, so that in each case a part stream of cooling liquid mixed with gas bubbles enters the vent line and is conveyed to the compensating tank where the gaseous constituents can bubble out. The layout of the vent line within the heat exchanger involves a high expense. Also the efficiency of such an arrangement is not especially high, since gas separation occurs only at higher flow speeds, whereas, at low flow speeds, the gas bubbles are transported along the upper pipe wall of the forward-flow pipe and consequently cannot enter the vent line leading away at a lower level. Thus, when the heat exchanger is used as a heating heat exchanger with a low heating capacity cooling liquid mixed with the gas being still always transported, this arrangement causes an annoying gurgling and sloshing noise in the vehicle interior. The conditions are even more unfavorable when the heat exchanger is arranged upright and the flow passes through it from the top downwards.

An object of the invention is to provide a venting facility which has a simple construction and can be connected easily and which separates the greatest possible amount of gas, particularly also at low flow speeds, so that gurgling and sloshing noises are avoided.

In a heat exchanger of the above-noted type, this object is achieved by providing an arrangement wherein the vent line is brought into the operative position together with the fastening of the forward-flow pipe and leads away from the highest point of the forward-flow water box to a compensating tank spaced therefrom. Components built into and onto the heat exchanger are therefore restricted to a minimum. Because the forward-flow pipe and the vent pipe are connected simultaneously, there is no need for any special connection measures as regards the vent line. Because the connection of the vent line is placed high there is an especially good discharge of cooling liquid mixed with gas.

In a preferred exemplary embodiment of the invention necessitating no modifying measures at all on the forward-flow water box, the vent line enters the forward-flow pipe from above, with angling, on the heat-exchanger side and comes out of the latter on the mouth side thereof.

In another exemplary embodiment of the invention, a collecting space from which the vent line leads away is formed above the opening of the forward-flow pipe into the forward-flow water box.

When the heat exchanger is equipped with at least one return-flow water box incorporated in the upper forward-flow water box and partitioned off by walls, the degree of gas separation can be increased by including at least one high-placed overspill orifice of small width in the separating wall partitioning off each return-flow water box from the forward-flow water box.

Other objects, advantages and novel features of the present invention will become apparent from the following detailed description of the invention when considered in conjunction with the accompanying drawings.

DETAILED DESCRIPTION OF THE DRAWINGS

Figure 1:
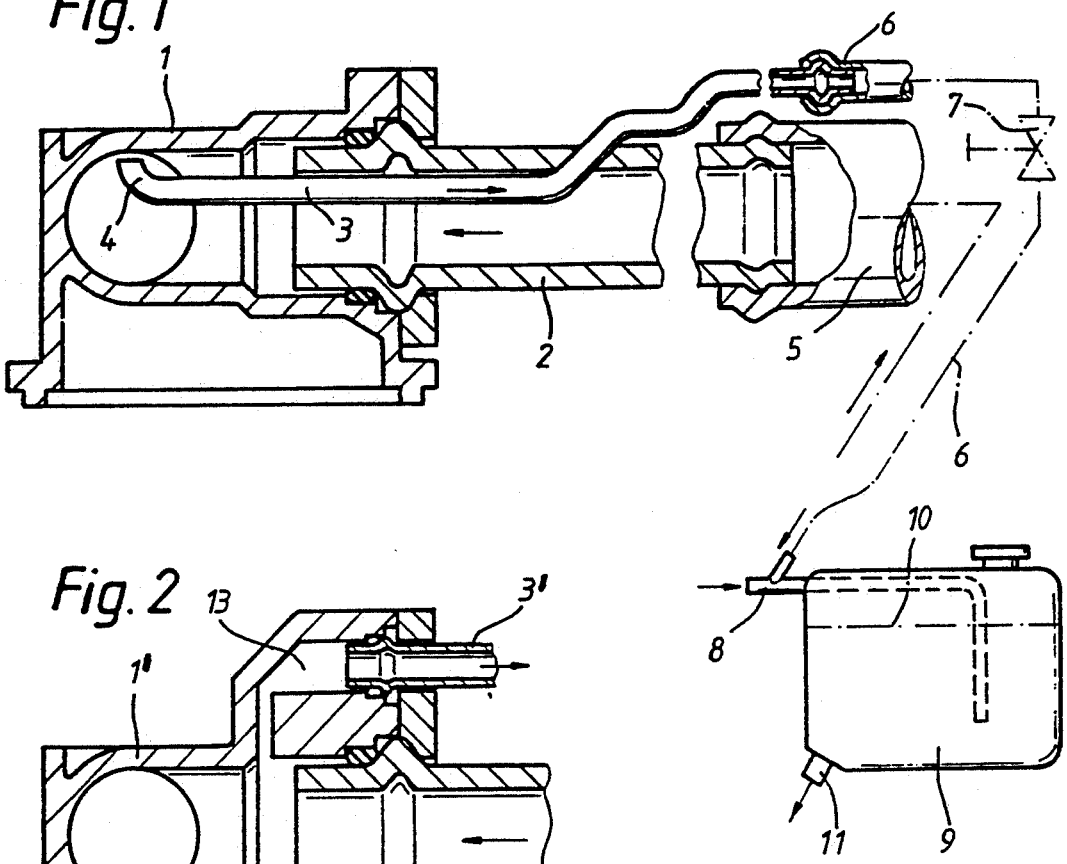
FIG. 1 shows a partial schematic sectional view through the inflow-pipe mouth region with a vent line coming out of the forward-flow pipe of a cooling circuit, constructed according to a preferred embodiment of the invention.

Flanged onto a forward-flow water box 1 according to FIG. 1, is a forward-flow pipe 2 which is attached to a tube bundle in a way not shown. A vent line 3 extends out of forward flow pipe 2 with a projecting length and terminates in an upward angling 4. The vent line 3 extends for some distance within the forward-flow pipe 2 and then extends outwardly. A hose line 5 received by the forward-flow pipe 2 is connected to the heating-water forward flow of a cooling-water circuit (not shown) of an internal-combustion engine. A hose line 6 is connected to the vent line 3. Hose line 6, with a valve 7 interposed, opens into a line 8 leading from a cooling-water thermostat (not shown) to a compensating tank 9, where it terminates below the indicated liquid level 10. The compensating tank 9 is connected to the suction side of a cooling-water pump, likewise not shown, via a pipe connection 11 and a line (not shown) joined to this.

Figure 3:
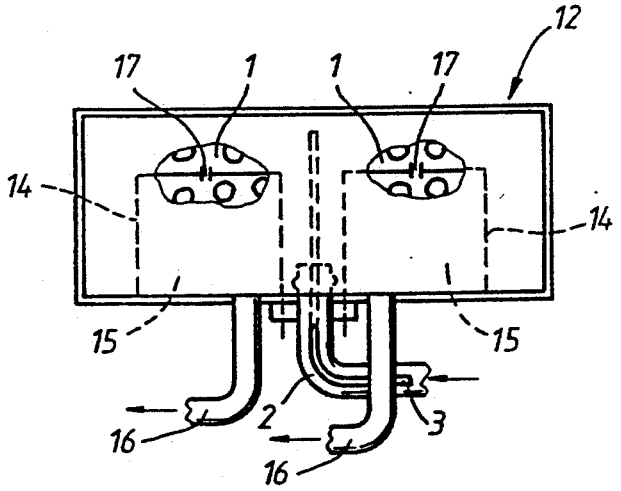
FIG. 3 shows a top view of a two-zone heating heat exchanger with an overspill bore between forward-flow water box and each return-flow water box.

When the internal combustion engine is running, it can happen that there is an overflow of gasses into the cooling liquid as a result of leaks in the cylinder-head gasket. The gas bubbles are carried along by the stream of cooling water and collect in the upper forward-flow water box 1. Especially with regard to a heating heat exchanger 12 arranged upright, as shown in FIG. 3, when the heating-water streams are small the included gas bubbles are not transported counter to the direction of lift, so that gurgling or sloshing noises could occur over a period of time. Because the heating heat exchanger 12 is in the immediate vicinity of the passenger space these noises would be clearly perceptible. To ensure that there is no gas accumulation, a relatively small liquid stream, possibly mixed with gas, is drawn off via the vent line 3 and conveyed to the compensating tank 9, where it emerges below the liquid level 10. Because of the low flow velocity prevailing in the compensating tank 9, the gas can bubble out of the cooling liquid and collect in the space above the liquid level 10.

Figure 2:
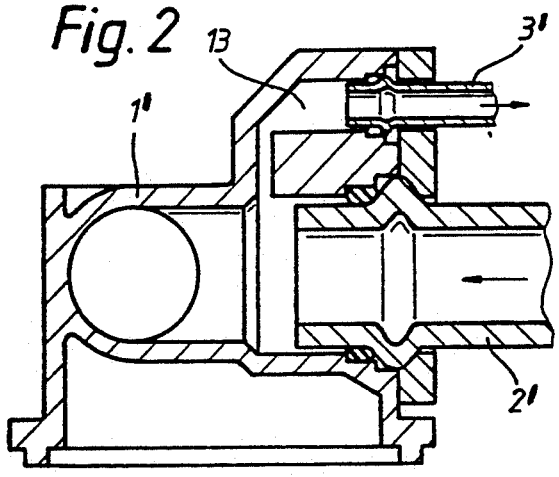
FIG. 2 shows a partial schematic sectional view similar to FIG. 1 of a second embodiment with a vent line connected above the forward-flow pipe.

In the exemplary embodiment according to FIG. 2, once again the forward-flow pipe 2' is fixed, together with the vent line 3', to the upper forward-flow water box 1'. However, the vent line 3' is located above the forward-flow pipe 2' and opens into a collecting space 13 which is formed on the forward-flow water box 1'. The further line arrangement corresponds to that according to FIG. 1.

According to the representation of FIG. 3, vertical separating walls 14 partition off two return-flow water boxes 15 from the forward-flow water box 1. A return-flow pipe 16 leads away from each return flow water box 15. The cooling-water stream is deflected in a lower water box in a way not shown. This known arrangement serves for obtaining a heat exchanger with a heating capacity which can be set individually for each half of the vehicle. An overspill orifice 17 of small width is made in each of the separating walls 14 and is preferably located at the highest point of each return-flow water box 15, so that there is also a venting of the heat-exchanger return flow to the forward-flow water box 1.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. Heat exchanger apparatus comprising a coolant circuit upper forward-flow coolant box, a compensating tank, a forward-flow pipe opening into an upper part of the coolant box, a vent line of small cross-section above the forward-flow pipe, said vent line being guided to the compensating tank and terminating below liquid coolant level in the compensating tank, and a cover plate, for attaching the forward flow pipe and the vent line to the coolant box at a collecting space, wherein said vent line opens to the coolant box at an uppermost portion of the coolant box, and wherein said collecting space is formed at the opening of the forward-flow pipe on the forward-flow coolant box, the vent line leading away from the collecting space.

2. Heat exchanger apparatus according to claim 1, wherein said forward-flow pipe and said vent line are separate from one another and are together detachably attached to the coolant box.

3. Heat exchanger apparatus according to claim 1, wherein the collecting space is integrally formed with the coolant box.

4. Heat exchanger apparatus according to claim 1, wherein said forward-flow pipe and said vent line are separate from one another and are together detachably attached to the coolant box.

5. A method for making a heat exchanger for an engine cooling circuit of a motor vehicle, with a forward-flow pipe opening at the top into a coolant box and with a vent line of small cross-section which is above the forward-flow pipe and which is guided to a compensation tank and there terminates below the coolant level, and with a cover plate for attaching the forward flow pipe and the vent line to the coolant box at a collecting space said process comprising bringing the vent line into the operative position such that the vent line leads away from the highest point of the forward-flow coolant box to the compensation tank space therefrom, wherein said collecting space is formed at the opening of the forward-flow pipe on the forward-flow coolant box, the vent line leading away from the collecting space.

6. A method according to claim 5, wherein the collecting space is integrally formed with the coolant box.

7. A method according to claim 6, wherein said forward-flow pipe and vent line are separate from one another and are together detachably attached to the coolant box.

* * * * *